US006125669A

United States Patent [19]

McDaid et al.

[11] Patent Number: 6,125,669

[45] Date of Patent: Oct. 3, 2000

[54] PORTABLE SECURITY FRAME FOR PORTABLE ARTICLES

[75] Inventors: Cornelius McDaid, Dorchester; John D. Fiegener, Mendon, both of Mass.; Michael Poirier, Coquitlam, Canada

[73] Assignee: Kryptonite Corporation, Canton, Mass.

[21] Appl. No.: 09/382,740

[22] Filed: Aug. 25, 1999

[51] Int. Cl.[7] ..... E05B 69/00

[52] U.S. Cl. ..... 70/58

[58] Field of Search ..... 70/14, 18, 19, 70/57, 58, 59, 232; 248/551–553; 224/42.26

[56] References Cited

U.S. PATENT DOCUMENTS

| | | | |
|---|---|---|---|
| 555,829 | 3/1896 | Rogers | 70/14 |
| 2,655,806 | 10/1953 | Stiler | 70/57 |
| 3,695,071 | 10/1972 | West | 70/225 |
| 4,024,738 | 5/1977 | Pi | 70/59 |
| 4,028,913 | 6/1977 | Falk | 70/58 |
| 4,081,978 | 4/1978 | Ivey | 70/58 |
| 4,296,615 | 10/1981 | Zoor | 70/19 |
| 4,326,747 | 4/1982 | Finnegan | 70/19 X |
| 4,453,692 | 6/1984 | LeDoux et al. | 248/552 |
| 4,585,202 | 4/1986 | Parsekian | 248/553 |
| 4,598,561 | 7/1986 | Girard | 70/58 |
| 5,018,374 | 5/1991 | Montano . | |
| 5,036,683 | 8/1991 | Geuvjehizian | 70/18 |
| 5,076,531 | 12/1991 | Delaney . | |
| 5,085,395 | 2/1992 | Frater et al. . | |
| 5,135,197 | 8/1992 | Kelley et al. | 248/551 |
| 5,595,074 | 1/1997 | Munro . | |
| 5,642,634 | 7/1997 | Perry . | |
| 5,732,577 | 3/1998 | Okada et al. | 70/18 |
| 5,794,464 | 8/1998 | Yeager et al. | 70/57 |
| 5,836,183 | 11/1998 | Derman | 70/58 |
| 5,913,906 | 6/1999 | Strocchi | 70/58 X |
| 5,987,936 | 11/1999 | Hartman, Jr. | 70/58 X |
| 6,012,739 | 1/2000 | Weiss et al. | 70/58 X |
| 6,029,580 | 2/2000 | Alfonso et al. | 248/552 X |

*Primary Examiner*—Suzanne Dino Barrett
*Attorney, Agent, or Firm*—Morse, Altman & Martin

[57] ABSTRACT

A security frame for securing a portable article to a stationary object. The body of the security frame has at least one central arm with two legs connected at the outer end by a cross piece, and a pair of outer arms, each having two legs connected at the outer end by a cross piece. A first joint attaches the inner end of one leg from each arm together and a second joint attaches the inner end of the other leg from each arm together. The joints are preferably pivoting to allow the arms to pivot between a collapsed state and an open state. Both joints have openings that are axially aligned. A locking shaft extends through the first opening and then the second opening, and has a stop to prevent it from going completely through the first opening. The portable article fits within the legs of the arms and is retained there by the locking shaft. The locking shaft includes a locking mechanism that is a component of a means by which the locking shaft is secured into said openings and to a stationary object.

18 Claims, 7 Drawing Sheets

PORTABLE SECURITY FRAME FOR PORTABLE ARTICLES

BACKGROUND OF THE INVENTION

1. Field of the Invention

The present invention relates to security devices, more particularly, to a security device for portable computers that encircles the computer to prevent theft.

2. The Prior Art

As portable or laptop computers have become more common, theft of such computers has increased. There are a number of different types of devices on the market to deter such thefts, but few are robust enough to do more than mildly inconvenience a thief. There are several existing devices that are relatively robust, including the locking station of Munro, U.S. Pat. No. 5,595,074, and the apparatus of Frater et al., U.S. Pat. No. 5,085,395. The disadvantage of these prior art devices is they're lack of portability. The station of Munro, although apparently portable, is substantially larger than the computer itself, which makes it extremely impractical to carry along with the computer. And the apparatus of Frater et al. is designed for a fixed installation to a desk top or the like.

In addition, available portable security devices do not prevent access to the operation of the computer, they only attempt to prevent theft of the computer itself.

Thus, there remains a need for a relatively robust security device that is also portable and prevents access to the operation of the computer.

SUMMARY OF THE INVENTION

An object of the present invention is to provide a security device for portable computers that is itself portable and robust.

Another object is to provide a security device for portable computers that, in addition to preventing theft of the physical computer, secures the computer closed so that access to the operation of the computer is prevented.

The security frame of the present invention is for securing a portable article to a stationary object. The body of the security frame has at least one central arm with two legs connected at one end by a cross piece, and a pair of outer arms, each having two legs connected at one end by a cross piece. A joint attaches the other end of one leg from each arm together and another joint attaches the other end of the other leg from each arm together. The joints may be pivoting. Each joint has an opening and the two openings are axially aligned. A locking shaft extends through the first then second openings and has a stop to prevent it from going completely through the first opening. The portable article fits within the legs of the arms and is retained there by the locking shaft. The locking shaft includes a locking mechanism that is part of the means by which the locking shaft is secured into said openings and to a stationary object.

The security frame of the present invention has a body with at least one generally C-shaped central arm and a pair of generally C-shaped outer arms. Preferably, the arms are all approximately planar to each other to accommodate rectangular portable articles. The arms are preferably composed of a light-weight relatively rigid material. Optionally, each outer arm has a resilient roller that aids in preventing damage to the portable article. Optionally, the legs are covered by plastic liners that help prevent marring of or damage to the case of the portable article or to prevent damage to any item that the frame may be stored with when not in use.

The arms are connected by a pair of joints. The joints may be rigid so that the arms are fixed relative to each other, or, preferably, the joints are pivoting so that the outer arms can pivot toward or away from the central arm. The proximal end of each leg ends in a generally circular disk with a central opening. Each set of three disks is held together so that they can pivot relative to each other. Preferably, the joint is held together by a flanged ring inserted through the aligned openings of the disks. A washer with a snap ring residing in an internal annular groove is pushed onto the flanged ring until the snap ring snaps into an annular groove in the outer surface of the flanged ring. Other methods may be used to hold the joint together. A stop is built into at least one of the joints so that the outer arms cannot pivot from the central arm more than a predetermined angle.

The locking shaft is a generally cylindrical component that fits through the joint openings. The locking shaft extends through the joint openings and between the two joints to retain the portable article within the arms. One end is larger than the joint openings to provide a stop that prevents the locking shaft from passing completely through.

The locking shaft includes a means for securing the shaft into the joint openings and for securing the entire frame to a stationary object. The locking shaft has an internal locking mechanism that includes a housing, a cam shaft, and a cylinder. A key in the cylinder rotates the cam shaft. The locking mechanism uses a pair of opposed steel balls extending from holes near the small end of the locking shaft to secure the locking shaft in the joint openings. The balls are pushed out by the cam shaft when in the locked position. In the unlocked position, the balls are free to be pushed back into the holes.

In the preferred configuration, the locking shaft is secured to a stationary object by an anchor. The anchor is secured to the stationary object, typically by screws. An aperture in the small end of the locking shaft fits over a knob extending from the anchor. A pair of steel balls in the aperture are pushed into an annular groove in the anchor knob when the locking mechanism is in the locked position. The anchor screws are inaccessible when the locking shaft is secured to the anchor.

Optionally, a cable can be secured to the locking shaft. A plug at one end of the cable fits into a keyhole-shaped cable slot. When the locking mechanism is engaged the plug is secured in the slot.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

The security frame 10 of the present invention is intended for use with a laptop computer or other portable article 8 that is generally rectangular in shape. As seen in the figures, the frame 10 includes a body 12 and a locking shaft 14.

Figure 1:
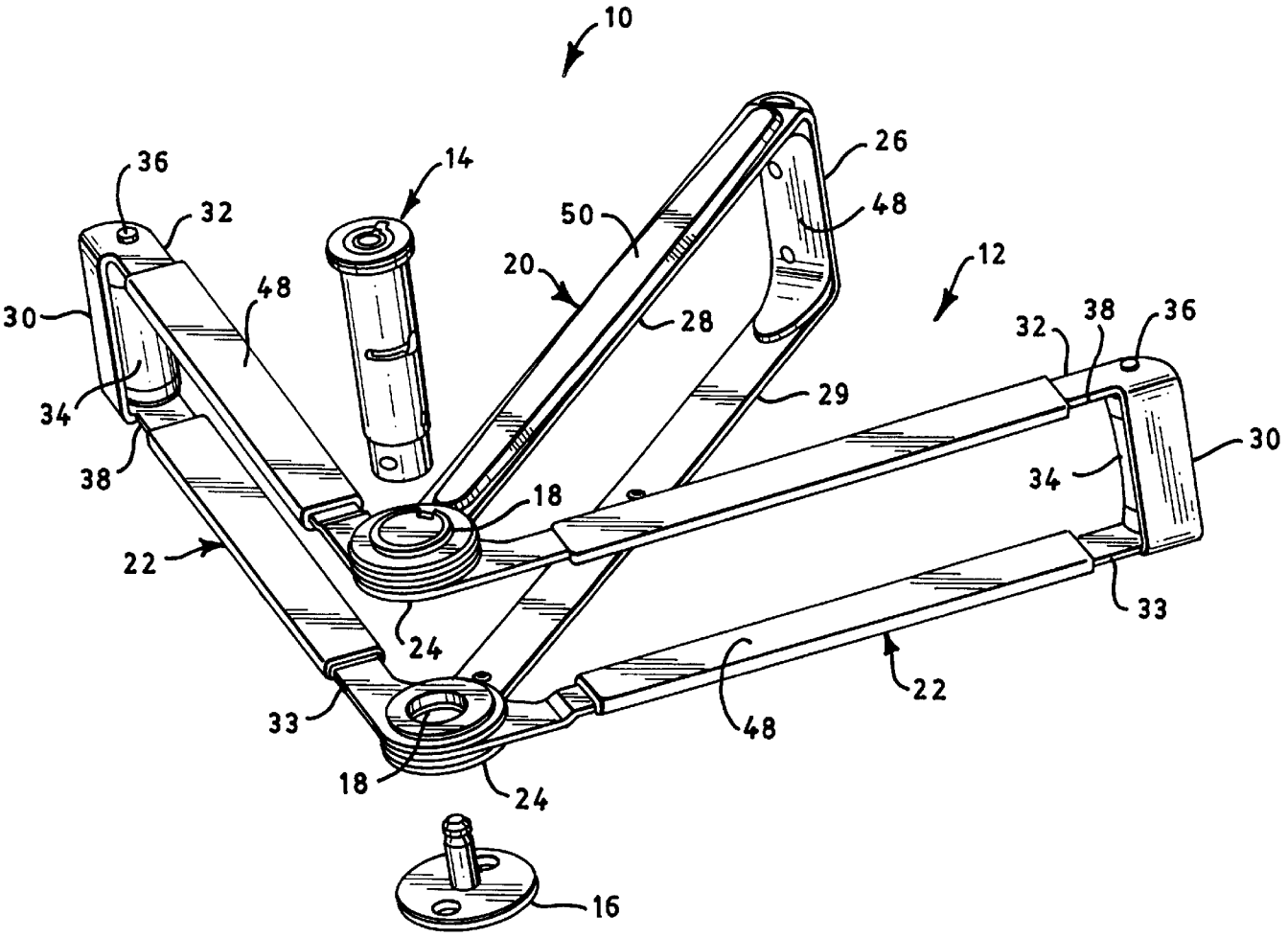
FIG. 1 is a partially exploded, top perspective view of the security frame of the present invention with three arms.
Figure 2:
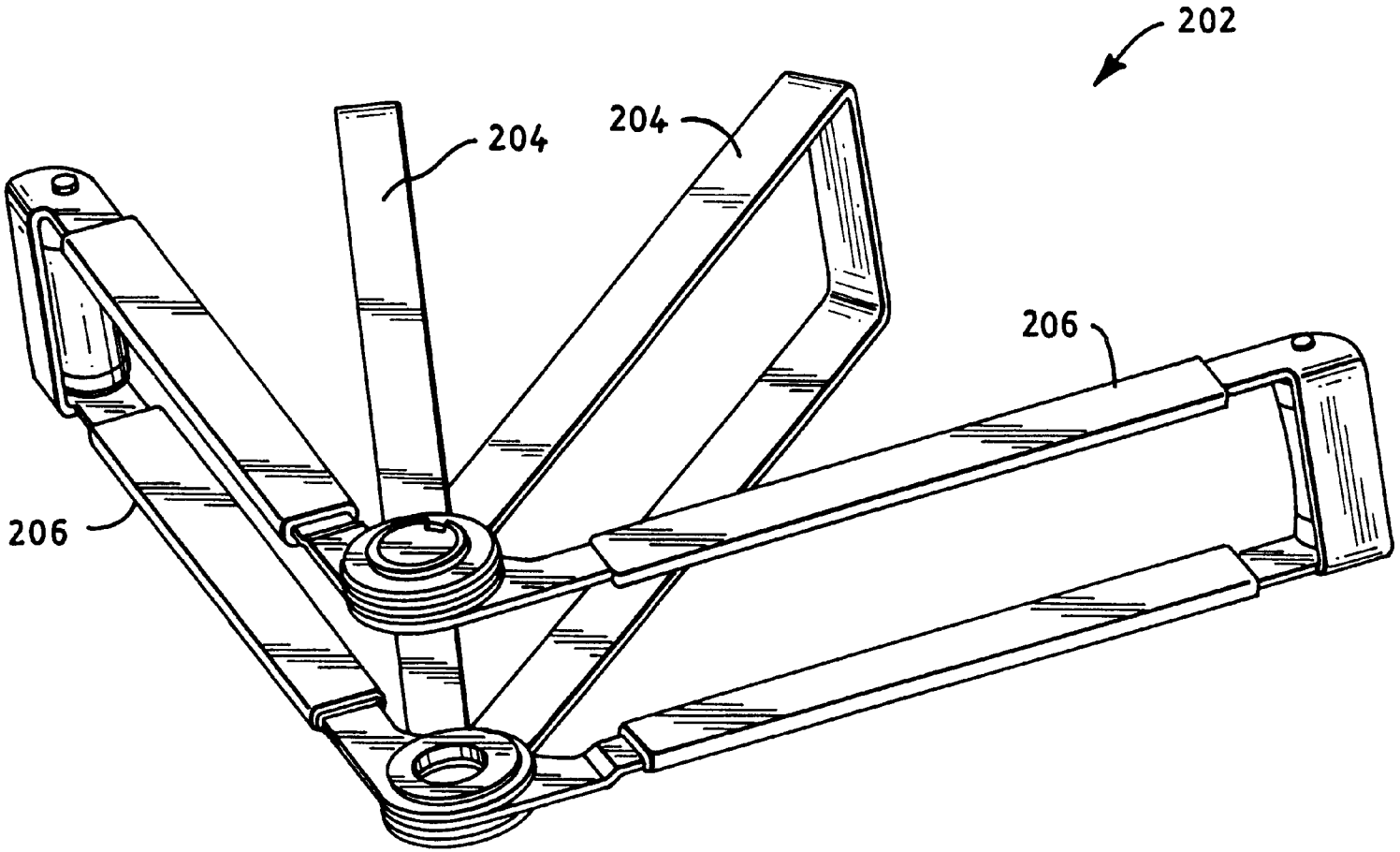
FIG. 2 is a top perspective view of the body of the security frame of the present invention with four arms.

In the preferred embodiment, shown in FIG. 1, the body 12 includes a central arm 20 and a pair of outer arms 22. In an alternate embodiment, shown in FIG. 2, the body 202 has two central arms 204 and two outer arms 206. The present invention contemplates that the body may have any number of arms. The remainder of this specification assumes the three-armed embodiment of FIG. 1, but applies to any number of arms.

The central arm 20 is generally C-shaped, with a cross piece 26 at the distal ends of a pair of legs 28, 29. The outer arms are also generally C-shaped, with a cross piece 30 between the distal ends of a pair of legs 32, 33. Preferably, the upper legs 28, 32 are approximately planar, the lower legs 29, 33 are approximately planar, and both planes are approximately parallel to each other to accommodate rectangular portable articles, the shape of the vast majority of laptop computers. However, it is also contemplated that the legs and planes may be angled to accommodate odd shapes.

Optionally, each outer arm has a roller 34 on an axle 36 parallel to the cross piece 30. The roller 34 is preferably composed of a relatively soft, resilient material that aids in preventing damage to the portable article 8. In this case, it is preferred that the cross piece 30 extend between the side edges 38 of the legs 32, as in FIG. 1, so that it does not interfere with the roller 34.

Figure 3:
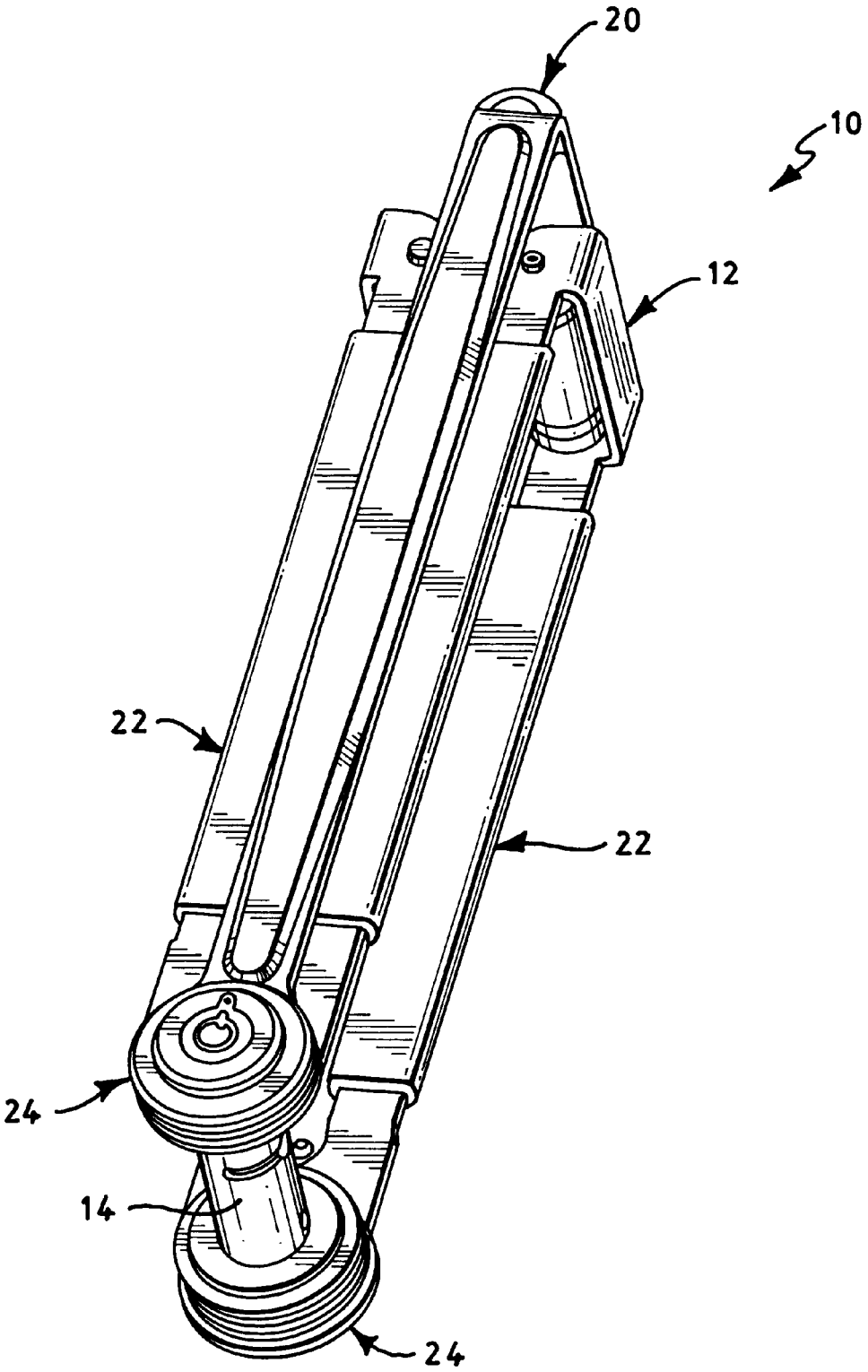
FIG. 3 is a perspective view of the preferred embodiment of the security frame body of FIG. 1 in its collapsed state.
Figure 4:
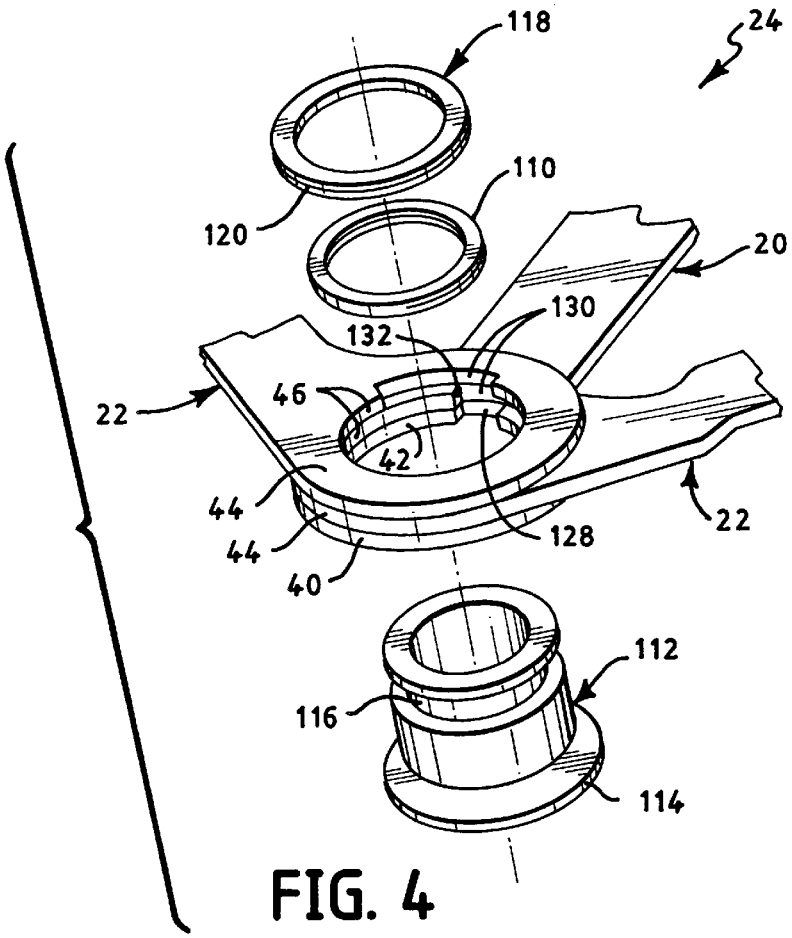
FIG. 4 is an exploded, perspective view of a pivoting joint.
Figure 5:
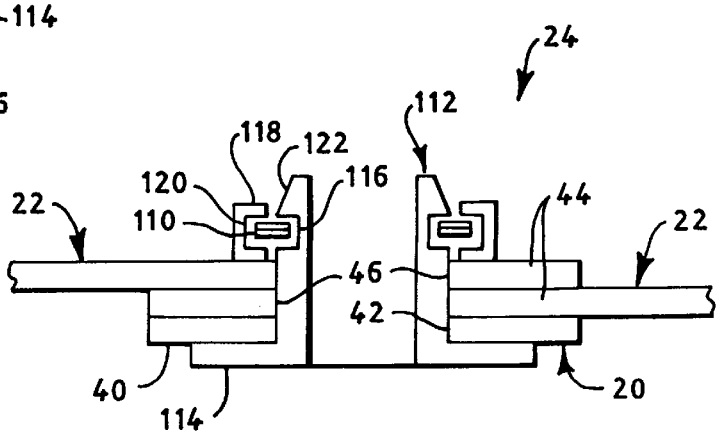
FIG. 5 is a cross-sectional view of the pivoting joint of FIG. 4.

The arms 20, 22 are connected at a pair of joints 24. It is contemplated by the present invention that the joints 24 may be fixed, that is, the arms 20, 22 are fixed relative to each other. It is preferred, however, that the joints 24 are pivoting, allowing the outer arms 20 to pivot away from each other to an open state, as in FIG. 1, and toward each other to a collapsed state, as in FIG. 3. One such pivoting joint is shown in FIGS. 4 and 5. The proximal end of each central arm leg 28 ends in a generally circular disk 40 with a central opening 42. The proximal end of each outer arm leg 32 also ends in a generally circular disk 44 with a central opening 46. The three disks 40, 44 are held together with the central openings 42, 46 aligned so that the disks 40, 44 can pivot relative to each other.

Preferably, the joint 24 is held together by a snap ring 110 as follows. A flanged ring 112 is inserted in the aligned openings 42, 46. The flange 114 is larger than the openings 44, 46 to act as a stop. The outer surface of the flanged ring 112 has an annular groove 116. A washer 118 with an annular groove 120 fits over the flanged ring 112. A spiral snap ring 110 residing in the washer groove 120 expands as the washer 118 is pushed onto the flanged ring 112 until it snaps into the flanged ring groove 116, securing the washer 118 to the flanged ring 112 and holding the joint 24 together. The flanged ring 112 is chamfered, as at 122, to facilitate expanding the snap ring 110.

The present invention contemplates that other methods may be used to hold the joint together. For example, a flanged ring is inserted in the openings and then the non-flanged end is flared so that it cannot be pulled back through the openings.

It is desired that the collapsed state of the frame 10 be as compact as practical. To that end, it is preferred that the arms 28, 32 be able to pivot as closely together as possible in order to minimize the size of the frame 10, as shown in FIG. 3. To accomplish this, the central arm disk 40 and disk opening 42 are aligned with the center of the leg 28, and the outer arm disk 44 and disk opening 46 are off center. This arrangement allows the arms to pivot so that all of the legs 28, 32 are parallel to each other, providing the most compact package.

Stops are built into the joint 24 so that the outer arms 22 to not pivot past a desired point. Depending upon the length of the arms 20, 22 and the size of the portable article 8 for which the frame 10 is designed, the outer arms 22 may be allowed to pivot from approximately 60° to approximately 120° away from each other. All methods of providing a pivot stop are contemplated by the present invention. However, it is highly desirable that the pivot stop not be accessible when the security frame 10 is in use. If it were accessible, a determined thief could disable the stop so that the outside arms 22 could pivot too far from each other, allowing the portable article 8 to be removed from the frame 10.

Figure 6:
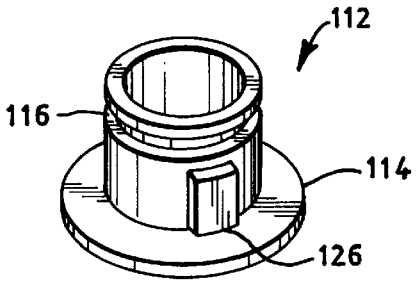
FIG. 6 is a perspective view of the flanged ring.

In the present embodiment, the pivot stop is not accessible once the joints have been assembled, as described above. As shown in FIG. 6, the flanged ring 112 has a protrusion 126 on its outer surface that seats in a notch 128 in the central arm opening 42. The central arm notch 128 is just larger than the protrusion 126 so that the flanged ring 112 cannot rotate in the central arm opening 42. The outer arm openings 46 each have a notch 130 that is extends over an arc of the desired pivot amount plus a small amount representing the width of the protrusion. As the outer arm 22 pivots away from the central arm 20, a radial edge 132 of the outer arm notch 130 eventually contacts the protrusion, preventing the outer arm 22 from further pivoting.

The arms 20, 22 are composed of a rigid material, preferably a metal such as aluminum. Aluminum is inexpensive, strong, and lightweight, enhancing the portability factor of the security frame. Other materials that are strong and lightweight, such as carbon composites and lightweight metal alloys, are also contemplated for use by the present invention.

Optionally, the metal legs 28, 32 are covered by plastic liners 48, typically of a standard ABS plastic, that help prevent marring of or damage to the case of the portable article 8. There may also be liners 50 on the outer surfaces of the central arm 20 to help prevent damage to any item that the frame 10 may be stored with when not in use.

The locking shaft 14, shown in FIG. 5, is a generally cylindrical component that fits through the openings 18 in the joints 24. One end 58 of the locking shaft 14 is larger than at least one of the joint openings 18 to provide a stop that prevents the locking shaft 14 from passing completely through. In one embodiment, both joint openings 18 are smaller than the large end 58 of the locking shaft 14, so that the locking shaft 14 can be inserted into either joint opening 18 first. In another embodiment, only one joint opening 18 is smaller than the large end 58 of the locking shaft 14, so that the frame 10 can only be used in one orientation. In yet another embodiment, both joint openings 18 are smaller than the large end 58 of the locking shaft 14, but one joint opening 18 is smaller than the other and the one end 60 of the locking shaft 14 is smaller than the other so that the frame 10 can only be used in one orientation.

The locking shaft 14 extends through the openings 18 and between the two joints 24 to retain the portable article 8 within the arms 20, 22. In one configuration, the locking shaft 14 can rotate within the openings 18, and in another configuration, the locking shaft 14 cannot rotate within the openings 18. In the later configuration, any manner that prevents rotation is contemplated, such as a key in the opening and a notch in the locking shaft 14.

The larger end 58 includes access to an internal locking mechanism 62, either via a keyway 64 or one or more combination dials. The locking mechanism 62 includes a housing 66, a cam shaft 68, and a cylinder 70. A barrel 72 rotates within a sleeve 74 of the cylinder 70 when operated by a key in the keyway 64. A tab 78 on the barrel 72 mates with a slot 76 on the cam shaft 68, causing the cam shaft 68 to rotate with the key. The cam shaft 68 has a locked position and an unlocked position, and operates various locking devices, depending upon the needs of the particular configuration of the present invention. The components are held together by a pin 90 that is press fit into a hole 92 in the housing 66 and into a hole 94 in the cylinder 70. The present invention contemplates that any locking mechanism that fits within the locking shaft 14 that performs the necessary functions can be used.

Figure 7:
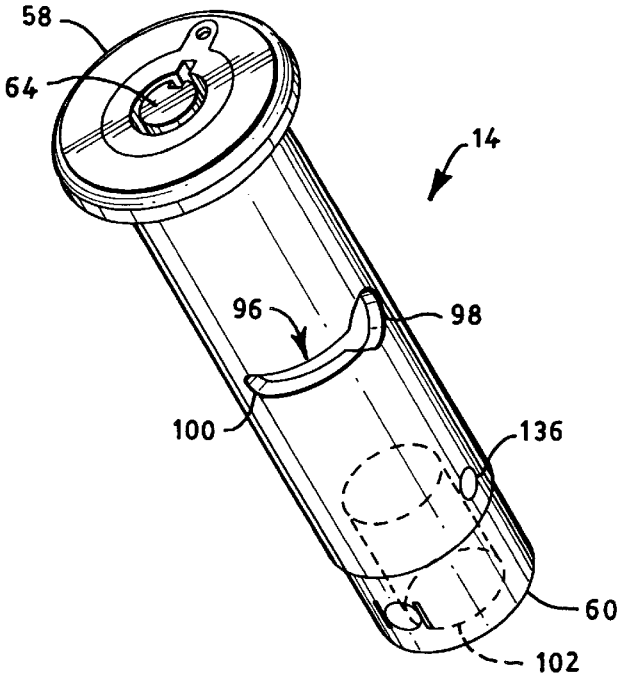
FIG. 7 is a perspective, partial phantom view of the locking shaft.
Figure 8:
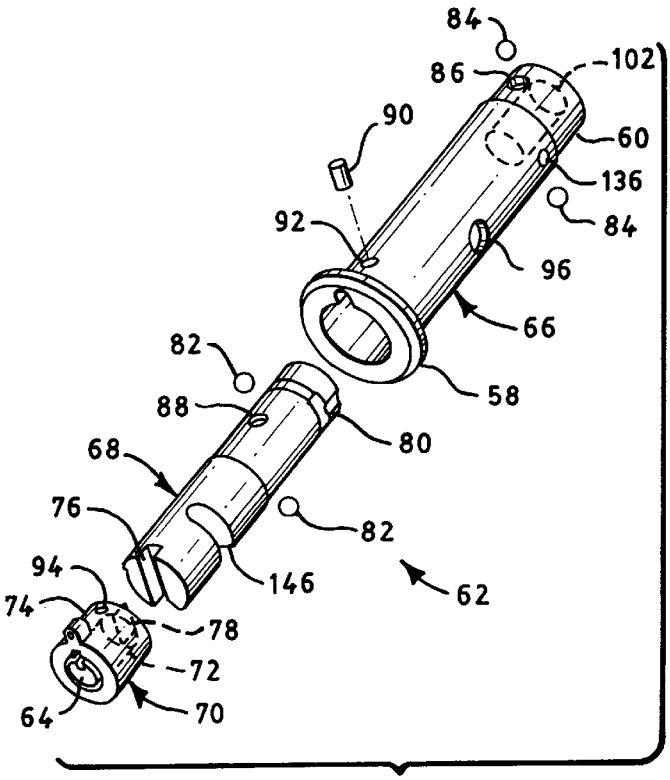
FIG. 8 is an exploded, perspective view of the locking shaft.

The locking shaft 14 includes a means for securing the shaft 14 into the joint openings 18 and for securing the entire frame 10 to a stationary object, such as a table or shelf surface 6. The embodiment of FIGS. 7 and 8 secures the locking shaft 14 to the body 12 and secures the entire frame 10 to a stationary object 6.

The first function is to secure the locking shaft 14 to the body 12. The smaller end 60 of the locking shaft 14 is sized to closely fit the joint opening 18. Residing in holes 86 in the housing 66 are a pair of steel balls 84. As the cam shaft 68 rotates, opposed cams 80 at the end of the cam shaft 68 push the balls 84 to extend out of the holes 86. The holes 84 have a lip that is smaller than the balls 84 so the balls 84 do not fall out of the holes 86. In the locked position, the balls 84 extend from the shaft housing 66 greater than the diameter of the joint opening 18 so that the locking shaft 14 cannot be pulled out of the joint opening 18. In the unlocked position, the balls 84 are free to be pushed back into the holes 86, allowing the locking shaft 14 to be removed from the joint openings 18.

Figure 9:
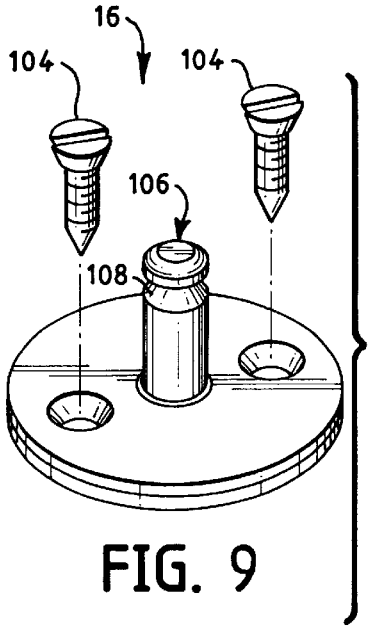
FIG. 9 is a perspective view of the anchor and one manner of installation.

The second function is to secure the body 12 to a stationary object 6. The smaller end 60 of the locking shaft 14 includes an aperture 90 that mates with a knob 106 on an anchor 16, as shown in FIG. 9. The anchor 16 provides a permanent fixture to which the portable article 8 is secured to prevent theft or other unauthorized removal. The anchor 16 is typically installed on a table or shelf surface 6, with the knob 106 extending upwardly out of the table surface 8. The manner of permanent installation depends upon the design of the anchor 16 and the type of surface to which it is attached. In one installation, an epoxy or other permanent adhesive in used to attach the anchor 16. In another installation, shown in FIG. 9, screws 104 are used to attach the anchor 16 to the surface 6 and the locking shaft 14 prevents access to the screws 104 when installed on the anchor 16.

The anchor 16 includes a knob 106 with an annular groove 108. The knob 106 fits within the locking shaft aperture 102. The locking mechanism 62 includes steel balls 82 that reside in holes 88 in the cam shaft 68. When the locking mechanism 62 is engaged, the inner wall of the housing 66 pushes to balls 82 inwardly and into the anchor groove 108. When the locking mechanism 62 is disengaged, the balls 82 are free to fit into holes 136 in the housing 66 so that the locking shaft 14 can be removed from the anchor 16.

Figure 10:
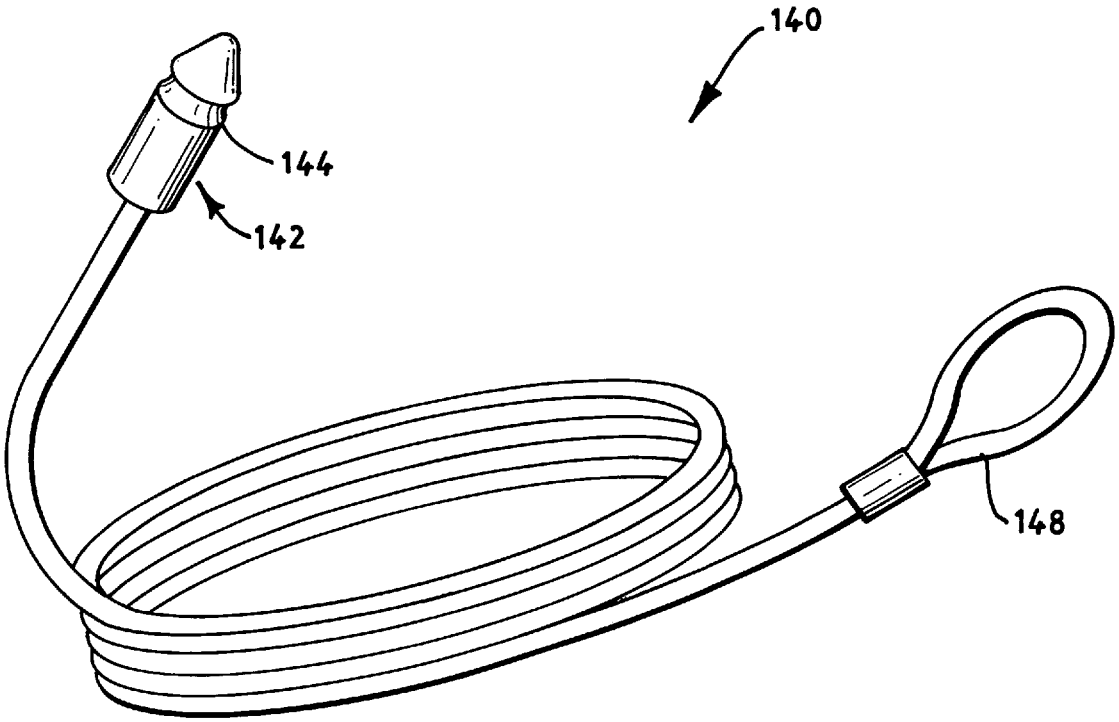
FIG. 10 is a perspective view of a cable for optional use with the present invention.

Optionally, a cable 140, shown in FIG. 10, can be secured to the locking shaft 14. The locking shaft 14 has a keyhole-shaped cable slot 96 into which a plug 142 at one end of the cable 140 fits. A notch 146 in the cam shaft 68 adjacent to the slot 96 provides space behind the slot 96 for the plug 142. The plug 142 has an annular groove 144. The plug 142 is inserted into the wide portion 98 of the cable slot 96 and slid over into narrow portion 100. The annular groove 144 prevents the plug 142 from being removed from the cable slot 96. When the locking mechanism 62 is engaged, the edge of the cam shaft notch 146 prevents the plug 142 from being slid back to the wide portion 98 of the cable slot 96 for removal. The other end of cable 140 can have any configuration desired, such as the swaged loop 148 shown in FIG. 10.

The present invention also contemplates that the portion of the locking mechanism 62 used to secure the locking shaft 14 into the joint openings 18 is not necessary. When the locking shaft 14 is secured into the anchor 16, that attachment secures the locking shaft 14 into the joint openings 18.

The frame 10 is sized so that the portable article 8 fits completely within. The distance between the two legs 28, 32 of the arms 20, 22 (or the liners 48, if used) is greater than the thickness of the portable article 8. The distance between the central arm cross piece 26 and the installed locking shaft 14 is greater than the width of the portable article 8. And the distance between the outer arm cross pieces 30 when pivoted fully away from the central arm 20 is greater than the length of the portable article 8. Although it is preferred that the portable article 8 fit relatively snuggly within the frame 10, it is also contemplated that the frame 10 may be designed in a limited number of standard sizes. The only size requirement is that the portable article 8 cannot be rotated within the frame 10 so that it can be slipped out of the frame 10 when the locking shaft 14 is engaged.

Figure 11:
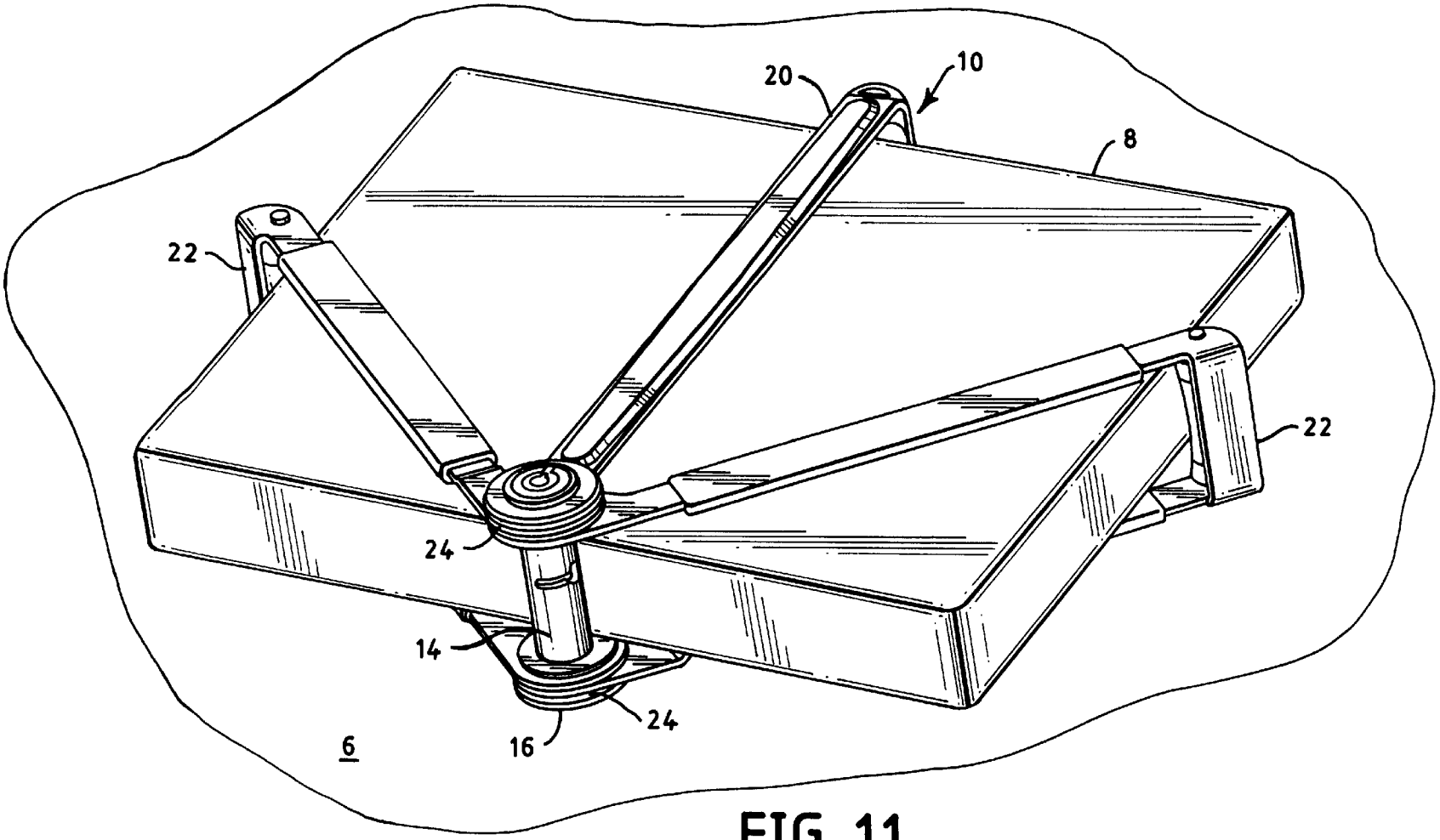
FIG. 11 is a perspective view of the security frame of the present invention in use.

FIG. 11 illustrates how the frame 10 of the present invention is used to secure a portable article 8. First, the locking shaft 14 is removed from the joint openings 18 and the outer arms 22 are pivoted fully away from the central arm 20 to an open state. Next, the portable article 8 is slipped into the body 12 between the legs 28, 32. Then the locking shaft 14 is inserted into the joint openings 18. How the frame 10 is secured to the stationary object depends upon the embodiment of the frame 10. If the anchor embodiment is used, the locking shaft 14 is plugged into the anchor 16. If a cable 140 is used, the cable 140 is looped around whatever it is securing and plugged into the cable slot 96. Finally, the locking mechanism 62 is engaged to secure the portable article 8. The portable article 8 is removed in the reverse order.

Thus it has been shown and described a portable security frame for portable article which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A security frame for securing a portable article to a stationary object, said security frame comprising:

(a) at least one central arm having a first leg and a second leg connected by a cross piece at a distal end of said central arm legs;

(b) a pair of outer arms, each having a first leg and a second leg connected by a cross piece at a distal end of said outer arm legs;

(c) a proximal end of said at least one central arm first leg and a proximal end of said outer arms first leg being connected at a first joint, said first joint having a first joint opening;

(d) a proximal end of said at least one central arm second leg and a proximal end of said outer arms second leg being connected at a second joint, said second joint having a second joint opening axially aligned with said first joint opening;

(e) a locking shaft adapted to extend through said first joint opening and into said second joint opening, and including a stop at a first end to prevent said locking shaft from passing completely through said first joint opening; and (f) a locking means for removably securing said locking shaft in said joint openings and to said stationary object and including a locking mechanism in said locking shaft;

(g) whereby said portable article is inserted between said first legs and said second legs, said locking shaft is inserted through said joint openings, and said locking means is engaged to secure said portable article to said stationary object.

2. The security frame of claim 1 wherein said locking means includes an anchor adapted to attach to said stationary object and said locking shaft includes an aperture at a second end thereof that mates with said anchor, said locking shaft being secured to said anchor when said locking mechanism is in a locked state and said locking shaft being removable from said anchor when said locking mechanism is in an unlocked state.

3. The security frame of claim 2 wherein said anchor is adapted to attach to said stationary object via screws that are inaccessible when said locking shaft is secured to said anchor.

4. The security frame of claim 1 wherein said joints are pivoting joints that allow said arms to pivot toward each other to a collapsed state and away from each other to an open state.

5. The security frame of claim 4 wherein at least one of said pivoting joints include a stop to prevent said arms from pivoting away from each other more than a predetermined amount.

6. The security frame of claim 4 wherein said collapsed state is such that all of said arms are approximately parallel to each other.

7. The security frame of claim 1 wherein said security frame includes a cable with a plug and said locking shaft includes a cable slot adapted to receive said plug, said plug being secured within said slot when said locking mechanism is in a locked state and said plug being removable from said slot when said locking mechanism is in an unlocked state.

8. The security frame of claim 1 wherein at least one of said legs includes a liner adapted to aid in preventing damage to said portable article by said frame.

9. The security frame of claim 1 wherein each of said outer arms includes a roller extending between said distal ends of said outer arm legs, said roller being adapted to aid in preventing damage to said portable article by said frame.

10. The security frame of claim 1 wherein said at least one central arm first leg and said outer arm first legs are approximately planar in a first plane and said at least one central arm second leg and said outer arm second legs are approximately planar in a second plane.

11. The security frame of claim 10 wherein said first plane and said second plane are approximately parallel.

12. A security frame for securing a portable article to a stationary object, said security frame comprising:

(a) at least one central arm having a first leg and a second leg connected by a cross piece at a distal end of said central arm legs;

(b) a pair of outer arms, each having a first leg and a second leg connected by a cross piece at a distal end of said outer arm legs;

(c) a proximal end of said at least one central arm first leg and a proximal end of said outer arms first leg being pivotally connected at a first joint, said first joint having a first joint opening;

(d) a proximal end of said at least one central arm second leg and a proximal end of said outer arms second leg being pivotally connected at a second joint, said second joint having a second joint opening axially aligned with said first joint opening;

(e) said joints allowing said arms to pivot toward each other to a collapsed state where said arms are parallel to each other and away from each other to an open state;

(f) at least one of said joints including a stop to prevent said arms from pivoting away from each other more than a predetermined amount;

(g) a locking shaft adapted to extend through said first joint opening and into said second joint opening, and including a stop at a first end to prevent said locking shaft from passing completely through said joint opening; and (h) a locking means for removably securing said locking shaft in said joint openings and to said stationary object and including a locking mechanism in said locking shaft;

(1) whereby said arms are pivoted to said open state, said portable article is inserted between said first legs and said second legs, said locking shaft is inserted through said joint openings, and said locking means is engaged to secure said portable article to said stationary object.

13. The security frame of claim 12 wherein said locking means includes an anchor adapted to attach to said stationary object and said locking shaft having an aperture at a second end thereof that mates with said anchor, said locking shaft being secured to said anchor when said locking mechanism is in a locked state and said locking shaft being removable from said anchor when said locking mechanism is in an unlocked state.

14. The security frame of claim 13 wherein said anchor is adapted to attach to said stationary object via screws that are inaccessible when said locking shaft is secured to said anchor.

15. The security frame of claim 12 wherein said security frame includes a cable with a plug and said locking shaft includes a cable slot adapted to receive said plug, said plug being secured within said slot when said locking mechanism is in a locked state and said plug being removable from said slot when said locking mechanism is in an unlocked state.

16. The security frame of claim 12 wherein at least one of said legs includes a liner adapted to aid in preventing damage to said portable article by said frame.

17. The security frame of claim 12 wherein each of said outer arms includes a roller extending between said distal ends of said outer arms legs, said roller being adapted to aid in preventing damage to said portable article by said frame.

18. The security frame of claim 12 wherein said at least one central arm first leg and said outer arm first legs are approximately planar in a first plane, said at least one central arm second leg and said outer arm second legs are approximately planar in a second plane, and said first plane and said second plane are approximately parallel.

* * * * *